United States Patent [19]

Murphy

[11] 4,031,018

[45] June 21, 1977

[54] AUXILIARY ANTIOXIDANTS

[75] Inventor: Zatis L. Murphy, Cypress, Tex.

[73] Assignee: Shell Oil Company, Houston, Tex.

[22] Filed: Jan. 28, 1976

[21] Appl. No.: 653,068

[52] U.S. Cl. ..... 252/47.5; 252/51.5 R; 252/51.5 A; 252/403

[51] Int. Cl.² ..... C10M 1/38

[58] Field of Search ..... 252/51.5 R, 51.5 A, 252/403, 47.5

[56] References Cited

UNITED STATES PATENTS

| | | | |
|---|---|---|---|
| 2,279,560 | 4/1942 | Dietrich | 252/51.5 A X |
| 2,377,909 | 6/1945 | Vaness et al. | 252/51.5 A X |
| 2,435,655 | 2/1948 | Rhodes et al. | 252/51.5 R |
| 2,796,407 | 6/1957 | Fields | 252/51.5 A |
| 3,078,230 | 2/1963 | Cyba | 252/51.5 R X |

OTHER PUBLICATIONS

Grant, "Hackh's Chemical Dictionary", 4th Edition, 1969, p. 62, aryl.

*Primary Examiner*—Delbert E. Gantz
*Assistant Examiner*—Andrew H. Metz

[57] ABSTRACT

N-acyl-0-carbamylhydroxylamines corresponding to the formula

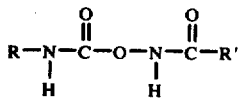

wherein R and R′ are the same or different aliphatic or aromatic hydrocarbyl radicals, are highly effective in improving the oxidation resistance of synthetic ester-based lubricant formulations containing arylamine antioxidants.

4 Claims, No Drawings

AUXILIARY ANTIOXIDANTS

BACKGROUND OF THE INVENTION

This invention relates to a means for providing enhanced oxidation stability to synthetic ester-type lubricating oil formulations containing conventional arylamine antioxidants. More particularly, this invention is directed to improved synthetic ester-based lubricating oil formulations containing arylamine antioxidants in combination with certain N-acyl-O-carbamylhydroxylamines which materially improve the high temperature oxidation stability of such formulations.

Synthetic ester-based oils are well known as base fluids for a variety of applications in the lubricant and hydraulic fluid field. In recent years, such synthetic oils have augmented or replaced petroleum oils in many uses in this field, especially those in which severe service conditions are encountered, e.g., high temperature and/or long drain period applications. While these synthetic ester-based fluids possess a number of properties — e.g., very high viscosity indexes, high flash points, low volatility, etc. — which have proven quite valuable in extending the operating range of lubricants and hydraulic fluids formulated therefrom, their ultimate utility remains limited by their high susceptability to oxidative degradation.

In the past, a number of efforts have been made to overcome, or at least minimize, the aforementioned tendency for synthetic ester-based fluids to undergo oxidative degradation under extreme operating conditions. A major effort in this regard has been the incorporation of additives such as conventional arylamine oxidation inhibitors, e.g., diphenylamine and phenothiazine, into the synthetic ester-based formulations. Although many of these arylamine oxidation inhibitors provide some measure of protection against oxidation, their deficiencies under severe operating conditions have been recognized and, as a result, it has been proposed to augment the arylamine antioxidant activity with supplemental agents such as antioxidant activators or auxiliary oxidation inhibitors. For example, in U.S. Pat. No. 3,347,791, it is disclosed that the resistance to oxidation provided by arylamine oxidation inhibitors in synthetic ester-based formulations can be enhanced by addition of an antioxidant activator comprising at least one alkali metal salt selected from the group consisting of alkali metal salts of carboxylic acids and alkali metal salts of hydroxy aromatic compounds. While these alkali metal antioxidant activators measurably increase the oxidation resistance of the arylamine-containing synthetic ester-based formulation, they present other problems relating to solubility in the base formulation and corrosivity to metal parts.

Accordingly, from the foregoing it can be seen that a continuing need exists for the development of additives which will enhance or supplement the antioxidant activity of conventional arylamine oxidation inhibitors in synthetic ester-based formulations, while, at the same, being compatible with the base formulation itself and its ultimate use application.

SUMMARY OF THE INVENTION

It has now been found that certain N-acyl-O-carbamylhydroxyl-amines described by the structural formula

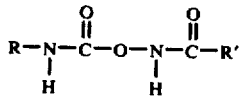

wherein R and R′ each represent an aliphatic or aromatic hydrocarbyl radical, are highly effective in improving the oxidation stability of synthetic ester oils containing arylamine antioxidants. In the absence of an arylamine antioxidant, these hydroxylamines show little or no activity themselves in inhibiting oxidation of synthetic ester-based oil formulations. However, when used in conjunction with an arylamine, these hydroxylamines materially reduce the rate of oxidation of the synthetic ester-based oil formulation over that observed for ester-based formulations containing the arylamine alone. Thus, the instant hydroxylamines, though otherwise inactive as antioxidants, surprisingly, appear to be strong auxiliary antioxidants or antioxidant synergists for conventional arylamines in ester-based formulations. Further, advantages accrue from the instant invention in that the hydroxylamines appear to be lightly compatible with the synthetic ester-based formulation from the standpoint of solubility and do not otherwise adversely effect the properties of the formulated product.

Accordingly, the instant invention comprises synthetic ester-based oil formulations containing the afore-described N-acyl-O-carbamylhydroxylamines in combination with conventional arylamine antioxidants.

DESCRIPTION OF THE PREFERRED EMBODIMENTS

As indicated above, the N-acyl-O-carbamylhydroxylamine auxiliary antioxidants employed in the synthetic ester-based oil formulations of the invention are compounds of the formula

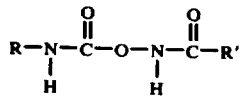

wherein R and R′ each represent an aliphatic or aromatic hydrocarbyl radical. By hydrocarbyl is meant monovalent organic radicals made up of carbon and hydrogen. In the case of the aliphatic hydrocarbyl radical, this substituent definition includes straight-chain, branched-chain and cyclic aliphatic radicals, either saturated or unsaturated, of 2 to 12 carbon atoms. Preferably, the aliphatic hydrocarbyl radical is a straight-chain, branched-chain or cyclic alkyl radical of 4 to 8 carbon atoms and most preferably a straight-chain alkyl of 5 to 7 carbon atoms. For the aromatic hydrocarbyl radical, the above substituent definition encompasses aryl, alkaryl and aralkyl radicals of 6 to 14 carbon atoms with aryl or aralkyl radicals of 6 to 10 carbon atoms, e.g., phenyl or tolyl, being preferred. While as indicated above, either or both of R and R′ may be an aromatic hydrocarbyl radical, it is preferred from the standpoint of auxiliary antioxidant activity that R and R′ both represent aliphatic hydrocarbyl radicals as defined above, and most preferably straight-chain alkyl radicals of 5 to 7 carbon atoms.

Exemplary species of these N-acyl-O-carbamylhydroxylamine auxiliary antioxidants include:

N-octanoyl-O-heptylcarbamylhydroxylamine

N-pentanoyl-O-heptylcarbamylhydroxylamine
N-nonanoyl-O-pentylcarbamylhydroxylamine
N-cyclohexanoyl-O-octylcarbamylhydroxylamine
N-octanoyl-O-phenylcarbamylhydroxylamine
N-benzoyl-O-heptylcarbamylhydroxylamine
N-neopentanoyl-O-octylcarbamylhydroxylamine
N-octanoyl-O-cyclohexylcarbamylhydroxylamine The N-acyl-O-carbamylhydroxylamines employed in the invention are conveniently prepared by reacting equal molar quantities of a hydroxamic acid (I) and an isocyanate (II) to yield the desired hydroxylamine product (III) according to the following equation:

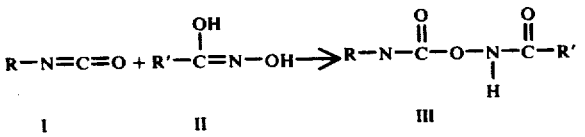

wherein R and R′ are the moieties designated above. This reaction is suitably carried out at temperatures ranging from 0° to 100° C in an inert organic solvent such as benzene or ethylacetate. Under these conditions, the reaction is generally complete in 0.5 to 16 hours. Upon completion of the reaction period the desired hydroxylamine product, which is typically a solid at temperatures below 50° C, can be readily recovered as a precipitate from the reaction solution by cooling of the solution and filtration followed by partial solvent removal and further cooling and filtration of the concentrated solution. This precipitated product can then be further purified by recrystallization from a polar solvent such as ethyl acetate or an ethyl alcohol-water mixed solvent.

The aliphatic or aromatic hydrocarbyl hydroxamic acids and isocyanates employed in the above synthesis scheme are quite conventional being either available commercially or readily obtainable from commercially available starting materials via known synthesis techniques. For example, the hydroxamic acid reactant can be easily prepared from an ester of a carboxylic acid and hydroxylamine or a salt of hydroxylamine by the preparation technique described in U.S. Pat. No. 2,397,508. Further, in cases where the desired aliphatic or aromatic hydrocarbyl isocyanate is not available commercially, it can be conveniently prepared by phosgenation of the corresponding amine.

The arylamine oxidation inhibitor employed in the synthetic ester based oil formulations of the invention is wholly conventional, being any one of the variety of arylamines previously utilized in this service. General classes of such known arylamine antioxidants which are suitable for use in the oil formulations of the invention include diphenylamines, N-phenylnaphthylamines, dinaphthylamines, phenothiazines and phenylenediamines. Of these known classes of arylamine oxidation inhibitors, highest antioxidant activity for formulations of the invention appears to be associated with the diphenylamines and N-phenylnaphthylamines. Accordingly, it is preferred that the arylamine antioxidant employed in the formulations of the invention be selected from the class consisting of diphenylamines and N-phenylnaphthylamines. Examples of diphenylamines in this preferred aspect of the invention include diphenylamine, N-methyldiphenylamine, p-octyldiphenylamine, p,p′-di-t-octyldiphenylamine and the like. Examples of preferred N-phenylnaphthylamines include N-phenyl-1-naphthylamine, N-phenyl-2-naphthylamine and N-(p-dodecylphenyl)-2-naphthylamine. To optimize antioxidant properties of the formulations of the invention, it is often desirable to utilize combinations of two or more arylamines selected from the above-mentioned classes of conventional oxidation inhibitors. In this regard, preferred combinations of arylamines include mixtures containing a diphenylamine component and a N-phenylnaphthylamine component. Most preferred is a combination of N-phenyl-1-naphthylamine and p,p′-di-t-diphenylamine in about a 1.2:1 weight ratio.

The synthetic ester base oil employed in the formulations of the invention includes any one of the variety of organic ester fluids conventionally utilized in the lubrication field; particularly those esters having good low temperature viscosity, i.e., those which are liquid at temperatures below 25° C. Such esters include diesters of dibasic acids, for instance, those derived from long-chain dicarboxylic acids and primary alcohols; diesters of glycols and monobasic acids; tri- and other polyesters including those derived from a monocarboxylic acid and a polyol such as trimethylolpropane, trimethylolethane, pentaerythritol and dipentaerythritol; and complex esters such as those formed by linking dibasic acid half esters through a glycol, a polyethylene glycol and the like. Suitable diesters of dibasic acids include those derived from straight- or branched-chain primary alcohols of 4 to 12 carbon atoms and aliphatic dicarboxylic acids of 3 to 20 carbon atoms. Examples of such diesters include diisooctyl adipate, diisodecyl adipate, bis(2-methylbutyl) sebacate, bis (2,2,4-trimethylpentyl) sebacate, diisooctyl azelate, diisoamyl adipate, di(2-ethylhexyl) adipate, di(3-methylbutyl) azelate and the like. Suitable diesters of glycols and monobasic acids are those derived from monobasic acids of 2 to 14 carbon atoms and alkanediols of 2 to 12 carbon atoms or polyalkylene glycols of up to 600 molecular weight. Examples of suitable glycol derived diesters include hexanediol 1,6-di(2-ethylhexanote); triethylene glycol (di-2-ethylhexanoate); polyethylene glycol bis(2-ethylhexyl) sebacate and the like. Suitable tri- and other polyesters are those derived from monocarboxylic acids of 4 to 12 carbon atoms and polyhydric alcohols of 3 to 20 carbon atoms. Examples of this class of polyol esters include trimethylolethane tripelargonate, trimethylolpropane, trihexanoate, pentaerythrityl tetrabutyrate, pentaerythrityl tetracaproate, pentaerythrityl butyrate trivalerate, pentaerythrityl mixed tetraesters of $C_{5-9}$ fatty acids, dipentaerythrityl hexavalerate, dipentaerythritol hexaheptoate, dipentaerythrityl trivalerate trinonylate and the like. Complex esters suitable for use in the invention include those prepared by reacting dicarboxylic acids with a mixture of monohydric alcohol and a glycol or by esterifying a glycol with a mixture of monohydroxy monocarboxylic acid and a monocarboxylic acid. Other suitable complex esters include those synthesized by polymerizing a dihydroxy compound with a dicarboxylic acid and reacting the terminal hydroxy and acid radicals on the compound formed with a mixture of a monocarboxylic acid and a monohydric alcohol. Examples of such complex esters include the reaction product of adipic acid, triethylene glycol and 2-ethylhexanol and the product formed by reacting a mixture of butyric acid and isoamyl alcohol with a polymer formed by polymerization of adipic acid and 1,2-propane diol.

Of the various classes of organic esters mentioned above, which can be suitably employed as the base fluid in the compositions of the invention, the tri- and other higher esters derived from monocarboxylic acids and polyols are particularly suited for high temperature applications where the instant compositions provide most beneficial. In this regard, most preferred are the pentaerythrityl and dipentaerythrityl esters of mixtures of carboxylic acids having 4 to 12 carbon atoms.

The concentrations of arylamine oxidation inhibitor and N-acyl-O-carbamylhydroxylamine auxiliary antioxidant employed in the ester oil compositions of the invention depend on a variety of factors including the ester oil composition used, the temperature of the environment in which it is to be employed and the degree of oxidation stability desired. In most use situations effective protection against oxidation can be obtained when the arylamine and hydroxylamine concentrations range from 0.5 to 10% and 0.05 to 2%, respectively, by weight of the ester base oil employed. Preferably, the arylamine is present at a concentration of from 1 to 3% and the hydroxylamine at a concentration of from 0.1 to 0.6%; both concentrations being based on the weight of the ester base oil. Since both the arylamine and N-acyl-O-carbamylhydroxylamine are quite soluble in the ester base oil, the oxidation inhibited compositions of the invention are readily obtainable merely by blending the desired quantities of the antioxidant additives into the base oil at 25°–80° C.

The lubricating compositions of the invention may also contain a variety of other conventional additives. For example, any of the additives recognized in the art to perform a particular function or functions, i.e., viscosity index improvers such as methacrylic polymers, other antioxidants, such as phosphorus or phenolic compounds, i.e., zinc dialkyl dithiophosphate, or 4,4'-methylene-bis(2,6-di-t-butylphenol); antifoam agents, corrosion inhibitors; anti-rust agents and the like can be used.

The following illustrative embodiments depict a method for preparing the N-acyl-O-carbamylhydroxylamine auxiliary antioxidants according to the invention and further show their exceptional properties in synergizing the antioxidant activity of arylamines in the ester-based lubricant formulations of the invention. It is to be understood, however, that these embodiments are presented for illustrative purposes only and that the invention in its broader aspects should not be limited thereto.

Illustrative Embodiment I

A solution of 141 g of heptyl isocyanate in 500 ml of ethylacetate was added slowly to a stirred solution of 159 g of octanohydroxyamic acid in 2000 ml of ethylacetate at 40° C. The warm solution was filtered and allowed to stand at room temperature overnight. The reaction was cooled to 0° C and the product crystallized within two hours. Filtration of the product and air-drying gave 130 g of N-octanoyl-O-heptyl-carbamylhydroxylamine, requiring no further purification. Concentration and cooling of the filtrate gave an additional 9 g of product. (Total yield 93%). The product had a melting point of 81°–82° C. Product analysis for $C_{16}H_{12}N_2O_3$ (calcd): C, 63.96; H, 10.74; N, 9.32: (Found) C, 65.49; H, 10.87; N, 9.13.

Illustrative Embodiment II

Several hydroxylamines according to the instant invention including N-octanoyl-O-heptylcarbamylhydroxylamine, which were prepared via the general technique described in Illustrative Embodiment I, were tested in the Micro Air Oxidation Test (MAOT) to demonstrate their effectiveness as auxiliary antioxidants for arylamines in synthetic ester oil formulations. For this test program, the hydroxylamines were blended at a concentration of 0.4 parts per 100 parts oil in a commercially available synthetic ester oil made up of mixed $C_5$–$C_9$ esters of pentaerythritol (Hercolube J-Hercules Powder Co) which also contained 1.84 parts of octylated N-phenyl-2-naphthylamine and 1.5 parts p,p'-di-t-octyl-diphenylamine (Vanlube 81 - R. T. Vanderbilt Co.) per 100 parts oil. The MAOT was conducted at 258° C, using 20 gram oil samples, as an air flow of 3.6 liters per hour. Table I below gives the results of this test program.

Table I

| 0-acyl-N-carbamyl-hydroxylamine tested ($RNHCO_2NHCOR'$) R | R' | Induction Period[a] Min ± 20 |
|---|---|---|
| Blank | (Reference Oil) | 0 |
| n-$C_7H_{15}$ | n-$C_7H_{15}$ | 325 |
| n-$C_7H_{15}$ | n-$C_5H_{11}$ | 540 |
| n-$C_7H_{15}$ | phenyl | 150 |
| phenyl | n-$C_7H_{15}$ | 350 |
| phenyl | n-$C_5H_{11}$ | 150 |
| n-$C_4H_9$ | n-$C_7H_{15}$ | 190 |
| n-$C_8H_{17}$ | n-$C_7H_{15}$ | 155 |
| n-$C_6H_{13}$ | n-$C_5H_{11}$ | 150 |

[a]air was bubbled through heated samples and the amount of oxygen absorbed by the sample from the air stream was measured at periodic intervals (each 20 min) throughout the test by means of an oxygen analyzer. The induction period is the time interval during the initial portion of the test wherein no significant continuing increase in oxygen absorption occurs.

Illustrative Embodiment III

To further demonstrate the advantages of the hydroxylamine additives of the invention with respect to oxidation stability and high temperature bearing performance, a Bearing Rig Test under severe type 2¼ conditions was conducted using a fully formulated synthetic ester-based lubricant composition containing arylamine oxidation inhibitor and N-octanoyl-O-octylcarbamylhydroxylamine. The chemical makeup of the ester base oil and arylamine antioxidants and the concentrations of arylamine antioxidant and hydroxylamine auxiliary antioxidant employed in this test were the same as those used in Illustrative Embodiment II. The results of the test are shown in Table II. The Bearing Rig Test is described in Military Specification MIL-L-23699.

Table II

| Bearing Rig Test 100 Hrs. Type 2¼ | Base Oil minus[a] Hydroxylamine | Base Oil Containing Hydroxylamine (0.4 parts/100 parts oil) |
|---|---|---|
| Overall Deposit Demerits (0 = clean) | 101.3 | 51.3 |
| Filter Deposits, g | 0.62 | 0.41 |
| Viscosity at 100° F % change | gelled | 365 |
| Acid Number Change | 7.1 | 3.8 |

[a]mixed $C_5$–$C_9$ esters of pentaerythritol base oil (Hercolube J) containing (parts/100 parts base oil): 1.84 parts octylated N-phenyl-2-naphthylamine; 1.5 parts p,p'-di-t-octyldiphenylamine; 1.0 parts tricresylphosphate; 0.02 parts azelaic acid; 0.25 parts methacrylate/N-vinylpyrrolidone copolymer, avg. MW 22,000.

What is claimed is:

1. A lubricant composition comprising a major amount of an ester lubricant base stock selected from the group consisting of esters of carboxylic acids and an oxidation inhibiting amount of a mixture consisting essentially of 1) an antioxidant selected from the group consisting of arylamines and phenothiazine and 2) a N-acyl-O-carbamylhydroxyl-amine auxiliary antioxidant corresponding to the formula

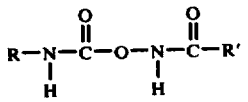

wherein R and R′ each represent a hydrocarbyl radical selected from the class consisting of straight-chain, branched-chain and cyclic aliphatic radicals of 2 to 12 carbon atoms, said hydrocarbyl radicals being saturated or unsaturated; or an aromatic hydrocarbyl radical selected from the class consisting of aryl, alkaryl and aralkyl radicals of 6 to 14 carbon atoms.

2. The composition according to claim 1 wherein the hydrocarbyl radical is selected from the class consisting of straight-chain, branched-chain or cyclic alkyl radicals of 4 to 8 carbon atoms.

3. The composition according to claim 2 wherein the aromatic hydrocarbyl radical is selected from the class consisting of aryl and aralkyl radicals of 6 to 10 carbon atoms.

4. The composition according to claim 3 wherein both of R and R′ represent straight-chain alkyl radicals of 5 to 7 carbon atoms.

* * * * *